United States Patent [19]

Zettier

[11] Patent Number: 4,631,049

[45] Date of Patent: Dec. 23, 1986

[54] CENTRIFUGE FOR CLARIFYING OR SEPARATING SUSPENSIONS

[75] Inventor: Karl H. Zettier, Oelde, Fed. Rep. of Germany

[73] Assignee: Westfalia Separator AG, Oelde, Fed. Rep. of Germany

[21] Appl. No.: 745,772

[22] Filed: Jun. 17, 1985

[30] Foreign Application Priority Data

Jul. 18, 1984 [DE] Fed. Rep. of Germany ..... 3426479

[51] Int. Cl.[4] ..... B04B 1/08

[52] U.S. Cl. ..... 494/71

[58] Field of Search ..... 494/70, 71, 72, 23, 494/27, 29, 30, 64, 67, 68, 69, 76, 85; 210/371, 380.1

[56] References Cited

U.S. PATENT DOCUMENTS

| | | | |
|---|---|---|---|
| 2,214,831 | 9/1940 | Hall | 494/71 |
| 2,578,485 | 12/1951 | Nyrop | 494/71 |
| 2,645,415 | 7/1953 | Strezynski | 494/71 |
| 3,047,214 | 7/1962 | Downing | 494/70 |
| 3,484,040 | 12/1969 | Honeychurch | 494/71 |
| 4,482,344 | 11/1984 | Zettier | 494/70 |

*Primary Examiner*—Robert W. Jenkins

*Attorney, Agent, or Firm*—Sprung Horn Kramer & Woods

[57] ABSTRACT

A centrifuge for clarifying or separating suspensions has a centrifuge drum with a bottom, a lid, an annular seal that unites them, a chamber that provides access for the suspension, and a distributor. The suspension can be supplied past the distributor to a package of conical plates provided with inner ascending channels. In order to process suspensions with a relatively high level of solid particles and with coarser particles, a diversion chamber is located below each inner ascending channel in the distributor, communicates with the access chamber, and has at least one calibrated aperture for separating off part of the suspension with its solids, the package of plates consists of an upper section and of a lower section, with the lower section also having ascending channels, which are positioned farther out and which the separated portion of the flowing suspension is supplied to, and pipe connections extend from the diversion chamber to the inner ascending channels in the upper section of the plate package and supply the rest of the flowing suspension to them.

6 Claims, 1 Drawing Figure

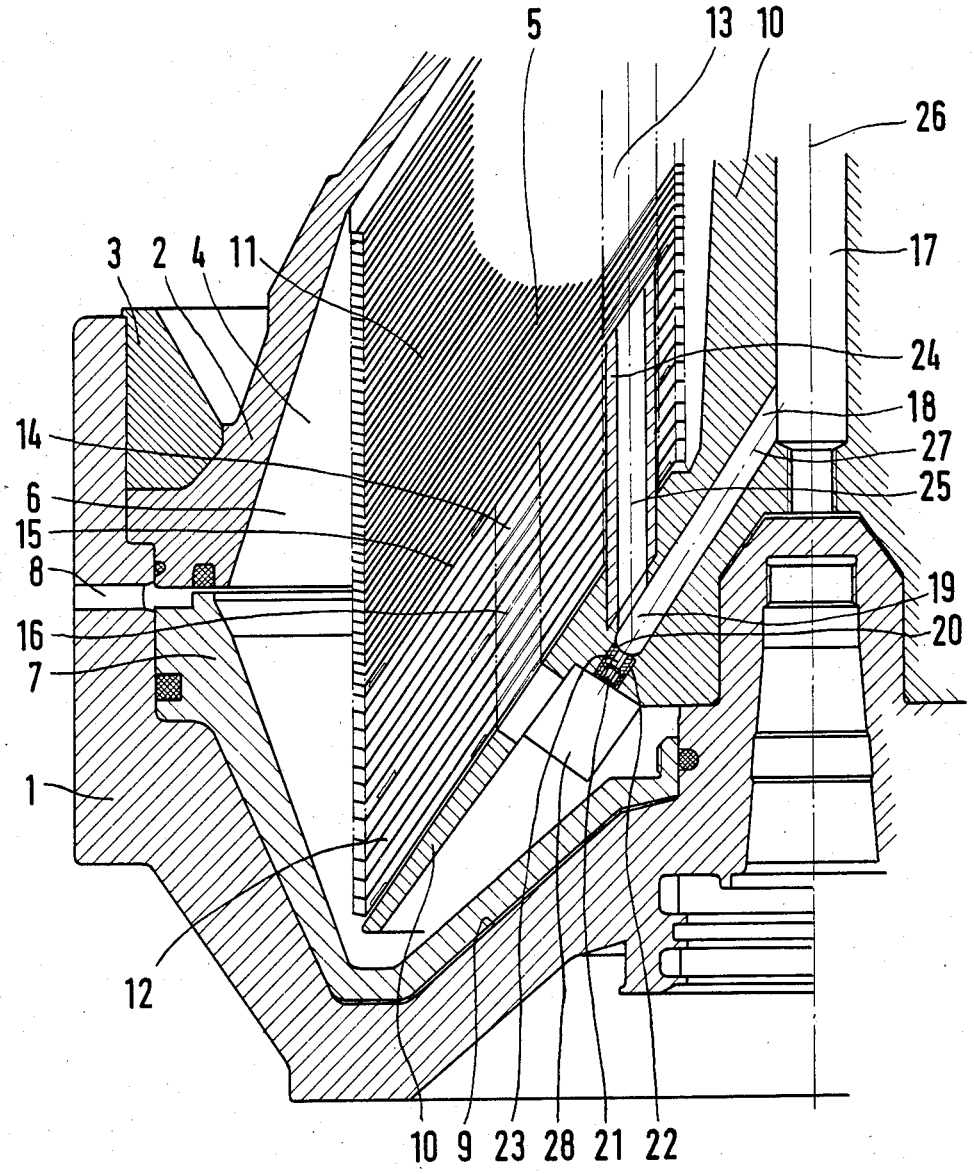
5
13
10
26
17
3
2
4
11
24
18
14
27
6
25
15
8
19
16
20
7
1
12
10
9
23
28
21
22

CENTRIFUGE FOR CLARIFYING OR SEPARATING SUSPENSIONS

BACKGROUND OF THE INVENTION

The present invention relates to a centrifuge for clarifying or separating suspensions and having a centrifuge drum with a bottom, a lid, an annular seal that unites them, a chamber that provides access for the suspension, and a distributor, past which the suspension can be supplied to a package of conical plates provided with inner ascending channels.

A centrifuge of this type is known, for example, from German OS No. 2 845 733. The suspension is supplied in this centrifuge to a sedimentation space from the access chamber. The portion of the suspension that does not enter the space is supplied to inner ascending channels by connections that are positioned stationary in the distributor. The sedimentation space has a gap in its bottom that can be closed off with a flexible ring. The drum has de-sludging apertures in the vicinity of its longest diameter. The apertures can be closed off by means of a liquid-activated sliding floor. While the sliding floor is closed the gap in the bottom of the sedimentation space is closed off by the flexible ring as the result of pressure acting on the ring. When the sliding floor is opened to allow the ejection of sludge, the gap is freed, allowing the solids collected there to be extracted. Only coarse solids will collect in the sedimentation space, with the product flowing along with its content of the rest of the solids through the interior ascending channels in the package of plates.

The point at which the liquid phases of the suspension are separated is in the vicinity of the ascending channels. The liquid phases are separated while the solid particles are being centrifuged out.

The gaps between the separate plates in the package are kept very small to obtain as high a level of clarification as possible in the centrifuge drum, leading with some types of solids to the clogging up of the ascending channels and of the gaps demarcated by the plates.

SUMMARY OF THE INVENTION

The object of the present invention is to provide a centrifuge of the type initially described that will process suspensions with a relatively high level of solid particles and with coarser particles.

This object is attained in accordance with the invention wherein a diversion chamber is located below each inner ascending channel in the distributor, the diversion chamber communicates with the access chamber, and has at least one calibrated aperture 21 for separating off part of the suspension with its solids, wherein the package of plates consists of an upper section and of a lower section. With the lower section also having ascending channels, which are positioned farther out and to which the separated portion of the flowing suspension is supplied, and wherein pipe connections extend from the diversion chamber to the inner ascending channels in the upper section of the plate package and supply the rest of the flowing suspension to them.

The flowing product is divided into two subsidiary flows with different solids contents in the diversion chambers in the centrifuge in accordance with the invention. The product is subject to cyclonic action in the diversion chambers, with the coarser and heavier particles being extracted through the calibrated apertures along with some of the liquid and supplied to the outer ascending channels in the plate package. Since these heavier solids can be separated more effectively in the higher centrifuging field of the outer channels, the channels will not get clogged up. The risk of clogging up the lower section of the plate package can also be additionally counteracted by increasing the distance between two adjacent plates in the lower section and hence the width of the gap.

The centrifuge in accordance with the invention can be employed to advantage to separate whey that contains cheese dust, which tends to clog up the ascending channels and the gaps between the plates of the centrifuges that have been employed up to the present time.

A preferred embodiment of the invention will now be described with reference to the attached drawing, wherein

BRIEF DESCRIPTION OF THE DRAWING

The FIGURE is a partial section through a centrifuge in accordance with the invention.

DETAILED DESCRIPTION OF THE INVENTION

The illustrated drum for a self-emptying centrifuge has a bottom 1, a lid 2, and an annular seal 3 that unites them.

The centrifuge space 4 of the drum consists of a separation space 5 and of a solids space 6. Solids space 6 is demarcated at the bottom by a slide valve 7 that, as it moves axially within bottom 1, closes off or releases solids-extraction apertures 8 positioned in a horizontal plane. A closure chamber 9 is associated with slide valve 7, supplying closure liquid to it to move it into the closure position. Closure chamber 9 can be switched between liquid supply and liquid removal.

A package of conical overlapping plates 15 is positioned in separation space 5. Each pair of adjacent plates demarcates a gap, in which the liquid phases of the product are separated and the solids simultaneously centrifuged out.

The plate package rests on a distributor 10 that is conical at the bottom to match the contour of the plate package.

The plate package consists of an upper section 11 and of a lower section 12. Upper section 11 has ascending channels 13 distributed around its inside and lower section 12 has ascending channels 14 distributed around it radially farther out. The two sections are separated by the bottom plate 15 in upper section 11. Plate 15 closes off ascending channels 14, which are constituted by holes 16 in the plates in lower section 12.

The suspension to be separated in the centrifuge is supplied to an access chamber 17 in distributor 10 and flows through channels 18 into diversion chamber 19. Below each inner ascending channel 13 is one diversion chamber 19, in which the suspension is subjected to a cyclone action. Each diversion chamber 19 has a diversion surface 20, in the vicinity of which there is at least one calibrated aperture 21 for separating part of the suspension along with its solids. The calibrated aperture 21 in the embodiment illustrated is located in a threaded piece 23 that is screwed into a threaded bore 22 in distributor 10. The particular diameter of the calibrated aperture 21 depends on how coarse are the particles to be separated from the suspension. The size of the openings will also determine how much product is diverted in diversion chamber 19 to outer ascending channels 14 and how much is supplied to the inner ascending channels 13 in the upper section 11 of the plate package.

The interchangeability of threaded piece 23 facilitates adapting the drum to various conditions.

The product that is diverted to outer ascending channels 14 by the calibrated apertures 21 in diversion chambers 19 contains more solids and is subjected to more powerful centrifuging forces, resulting in greater separation of the solids particles with no risk of clogging up ascending channels 14 or the gaps demarcated by the plates.

To reduce even more the risk of clogging up the lower section 12 of the plate package, it is possible to make the gaps between the plates in that section wider than in upper section 11.

The product that is not diverted through calibrated apertures 21 contains a lower level of solids and is supplied to the inner ascending channels 13 in the upper section 11 of the package through pipe connections 24. The longitudinal axis 25 of each pipe connection 24 is aligned with the longitudinal axis of its associated ascending channel 13 and parallels the axis 26 of rotation of the drum.

As will be evident from the drawing, there is an acute angle between longitudinal axis 25 and the longitudinal axis 27 of channel 18 that is laid out in such a way that product flowing from access chamber 17 is sharply diverted into diversion chamber 19, where it is subjected to a powerful cyclone action.

Pipe connections 24 can be interchanged in distributor 10, providing another means of adapting the centrifuge to different types of product.

The product that is diverted through calibrated apertures 21 is channeled to ascending channels 14 by ribs 28. Ribs 28 ensure optimal flow from each aperture to each channel. They extend only to the vicinity of an ascending channel 14. Next comes an unribbed area under the bottom of distributor 10 that backs up the flow to prevent the product from being channeled into solids space 6.

For some products it has turned out that simultaneously separating the liquid phases and centrifuging the solids out leads to problems in known centrifuges due to clogging up of the plate package. This has necessitated the use of a series of two differently equipped drums, which is expensive. The object of the invention makes it possible to carrying out both processes simultaneously, even with difficult products, without clogging.

It will be appreciated that the instant specification and claims are set forth by way of illustration and not limitation, and that various modifications and changes may be made without departing from the spirit and scope of the present invention.

What is claimed is:

1. In a centrifuge for clarifying or separating suspensions and having a centrifuge drum with a bottom, a lid, an annular seal uniting the bottom and lid, an access chamber for a the suspension, and a distributor past which suspension is supplied to a package of conical plates provided with inner ascending channels, the improvement comprising: a diversion chamber disposed below each inner ascending channel and in communication with the access chamber, wherein each diversion chamber has means forming at least one calibrated aperture for separating off part of the suspension with its solids; wherein the package of plates comprises an upper section and a lower section, with the lower section having outer ascending channels, which are positioned radially farther out than the inner ascending channels and to which the separated portion of the flowing suspension is supplied; and pipe connections extending from the diversion chamber to the inner ascending channels in the upper section of the plate package and supplying the remainder of the flowing suspension to the inner ascending channels.

2. The centrifuge as in claim 1, wherein the means forming the calibrated aperture comprises an interchangeable threaded piece.

3. The centrifuge as in claim 1, wherein the pipe connections are interchangable in the distributor.

4. The centrifuge as in claim 1, further comprising ribs for channeling the product from calibrated apertures to the outer ascending channels.

5. The centrifuge as in claim 4, wherein the ribs extend from the calibrated apertures to the vicinity of the outer ascending channels.

6. The centrifuge as in claim 1, wherein the gaps between the separate plates in the lower section of the package are wider than the gaps between the separate plates in the upper section.

* * * * *